US009840868B2

(12) United States Patent
Geiger

(10) Patent No.: US 9,840,868 B2
(45) Date of Patent: Dec. 12, 2017

(54) SHADE STORAGE AND DEPLOYMENT SCHEME

(71) Applicant: GeigTech East Bay LLC, Charleston, SC (US)

(72) Inventor: James Geiger, Charleston, SC (US)

(73) Assignee: Geigtech East Bay LLC, Charleston, SC (US)

( * ) Notice: Subject to any disclaimer, the term of this patent is extended or adjusted under 35 U.S.C. 154(b) by 0 days.

(21) Appl. No.: 14/970,117

(22) Filed: Dec. 15, 2015

(65) Prior Publication Data

US 2016/0168908 A1 Jun. 16, 2016

Related U.S. Application Data

(60) Provisional application No. 62/092,488, filed on Dec. 16, 2014.

(51) Int. Cl.
*A47H 1/13* (2006.01)
*E06B 9/42* (2006.01)

(52) U.S. Cl.
CPC ..... *E06B 9/42* (2013.01); *A47H 1/13* (2013.01)

(58) Field of Classification Search
CPC ..... A47H 1/13; E06B 9/42
USPC ..... 52/27, 29, 39, 64; 312/245, 246, 247; 359/461; 160/37
See application file for complete search history.

(56) References Cited

U.S. PATENT DOCUMENTS 3,467,460 A * 9/1969 Acker ..... A47B 61/02 312/242
4,060,310 A * 11/1977 Brown ..... G03B 21/58 160/310
4,516,618 A 5/1985 Gardner et al.
5,353,152 A * 10/1994 Realmuto ..... G03B 21/58 160/120
5,475,949 A * 12/1995 McCoy ..... B66B 9/00 312/242
D385,363 S 10/1997 Solbeck
(Continued)

FOREIGN PATENT DOCUMENTS

AU 2011265446 A1 * 7/2012

OTHER PUBLICATIONS

U.S. Appl. No. 29/512,034, filed Dec. 16, 2014, Geiger.
(Continued)

*Primary Examiner* — Babajide Demuren
(74) *Attorney, Agent, or Firm* — Foley & Lardner LLP

(57) ABSTRACT

A window shade storage and deployment system includes a recess formed in a ceiling and an access panel. The recess houses a window shade movable between a retracted position and an extended position. The access panel is removably attached to a surface of the recess such that a visible surface of the access panel occupies substantially the same plane as a visible surface of the ceiling surrounding the recess. A gap is provided between an edge of the access panel and the ceiling. The gap enables the window shade to extend through the gap from the recess to the area below the visible surface of the ceiling when the window shade is in the extended position. The visible surface of the access panel and the visible surface of the ceiling include the same or a similar material such that the visible surface of the access panel and the visible surface of the ceiling are visibly substantially identical.

20 Claims, 10 Drawing Sheets

(56) References Cited

U.S. PATENT DOCUMENTS

| | | | | |
|---|---|---|---|---|
| D432,667 | S | 10/2000 | Moller | |
| 6,250,728 | B1 * | 6/2001 | Thorp | A47B 51/00 292/32 |
| 6,283,427 | B1 | 9/2001 | Moller et al. | |
| D527,813 | S | 9/2006 | Dodge et al. | |
| D531,884 | S | 11/2006 | Fabrizi | |
| D582,055 | S | 12/2008 | Moller et al. | |
| 7,740,047 | B2 | 6/2010 | Koop et al. | |
| D669,771 | S | 10/2012 | Geiger | |
| D677,819 | S | 3/2013 | Mayfield et al. | |
| 8,807,192 | B2 | 8/2014 | Marocco | |
| D712,727 | S | 9/2014 | Geiger | |
| 2005/0183835 | A1 | 8/2005 | Nien | |
| 2005/0270644 | A1 * | 12/2005 | Devos | G03B 21/60 359/461 |
| 2008/0048537 | A1 * | 2/2008 | Chang | H05K 5/0217 312/205 |
| 2008/0289264 | A1 * | 11/2008 | Bowman | A47B 51/00 52/29 |
| 2011/0139382 | A1 | 6/2011 | Daniels | |
| 2012/0075697 | A1 * | 3/2012 | Astill | G03B 21/58 359/461 |
| 2012/0268815 | A1 * | 10/2012 | Hendricks | G03B 21/58 359/461 |
| 2012/0273140 | A1 | 11/2012 | Morales | |
| 2013/0235455 | A1 * | 9/2013 | Qingjun | G03B 21/58 359/461 |
| 2014/0133019 | A1 * | 5/2014 | Mullet | E06B 9/62 359/461 |
| 2015/0136941 | A1 | 5/2015 | Geiger | |

OTHER PUBLICATIONS

U.S. Appl. No. 29/512,038, filed Dec. 16, 2014, Geiger.

International Search Report and Written Opinion regarding PCT/US2013/041175, dated Sep. 12, 2013, 9 pages.

* cited by examiner

SHADE STORAGE AND DEPLOYMENT SCHEME

CROSS-REFERENCE TO RELATED APPLICATIONS

This application claims priority to and the benefit of U.S. Ser. No. 62/092,488 which was filed on Dec. 16, 2014 and which is incorporated herein by reference in its entirety.

BACKGROUND

To hide brackets and rollers of window shades from plain sight, contractors may install the brackets and rollers into a ceiling recess, removing them from plain sight. Such recesses typically have an opening through which a contractor may install and access a roller shade. The opening is typically covered such that the material of the cover abuts a material covering the ceiling base and a slit is left in the middle of the material covering the opening. The slit may allow a shade to be deployed into the room use to cover a window and allow the shade to be retracted from the room for storage. However, these current systems for storing and deploying roller shades typically create a visually unpleasing juncture at the interface of the material covering the ceiling base and the material covering the opening of the recess.

SUMMARY

An exemplary embodiment relates a window shade storage and deployment system. The window shade storage and deployment system includes a recess formed in a ceiling and configured to house a window shade movable between a retracted position and an extended position. The window shade storage and deployment system further includes an access panel removably attached to a surface of the recess such that a visible surface of the access panel occupies substantially the same plane as a visible surface of the ceiling surrounding the recess. A gap is provided between an edge of the access panel and the ceiling. The gap is configured to enable the window shade to extend through the gap from the recess to the area below the visible surface of the ceiling when the window shade is in the extended position. The visible surface of the access panel and the visible surface of the ceiling include the same or a similar material such that the visible surface of the access panel and the visible surface of the ceiling are visibly substantially identical.

Another exemplary embodiment relates to a shade storage and deployment system. The shade storage and deployment system includes a recess formed in a ceiling and configured to house a first shade and a second shade. The first and second shades are movable between a retracted position and an extended position. The shade storage and deployment system further includes an access panel removably attached to a surface of the recess such that a visible surface of the access panel occupies substantially the same plane as a visible surface of the ceiling surrounding the recess. A first gap is provided between a first edge of the access panel and a first edge of the ceiling and a second gap is provided between a second edge of the access panel and a second edge of the ceiling. The first gap is configured to enable the shade to extend through the first gap from the recess to the area below the visible surface of the ceiling when the first shade is in the extended position. The second gap is configured to enable the shade to extend through the second gap from the recess to the area below the visible surface of the ceiling when the second shade is in the extended position. The visible surface of the access panel and the visible surface of the ceiling include the same or a similar material such that the visible surface of the access panel and the visible surface of the ceiling are visibly substantially identical.

Another exemplary embodiment relates to a shade storage and deployment assembly. The shade storage and deployment assembly includes a housing configured to be installed in a recess of a ceiling. The housing includes a visible surface of the housing configured to occupy substantially the same plane as a visible surface of the ceiling surrounding the housing when the housing is installed in the recess of the ceiling. The housing further includes a window shade movable between a retracted position and an extended position. The housing further includes an access panel removably attached to a surface of the housing such that a visible surface of the access panel occupies substantially the same plane as the visible surface of the housing. A gap is provided between an edge of the access panel and the visible surface of the housing. The gap is configured to enable the window shade to extend through the gap from the housing to the area below the visible surface of the ceiling when the shade is in the extended position. The visible surface of the access panel and the visible surface of the housing include the same or a similar material as the visible surface of the ceiling such that the visible surface of the access panel, the visible surface of the housing, and the visible surface of the ceiling are visibly substantially identical.

DETAILED DESCRIPTION

Figure 1A:
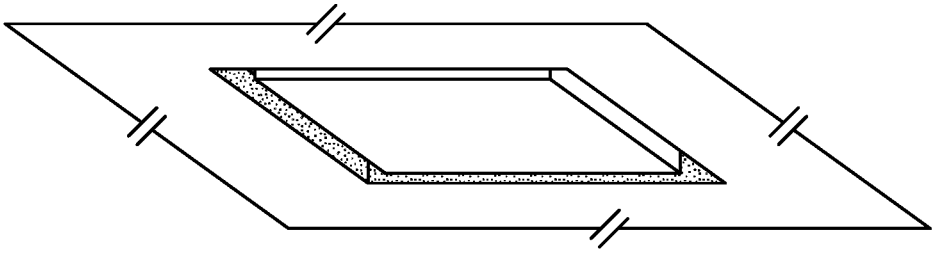
FIG. 1A-1C are perspective views of an example shade storage and deployment system according to an implementation described herein.

FIGS. 1A-10C are attached thereto and incorporated herein by this reference. The following detailed description refers to the accompanying FIGS. 1A-8. The same reference numbers in different figures may identify the same or similar elements.

The systems, methods, apparatuses, devices, technologies, and/or techniques (hereinafter referred to as the "system"), described herein, may enable a visually pleasing juncture to be created between a material covering a recess, in which mounts and shades are installed, and a material covering a ceiling base.

The system may include one or more mount that is configured to be secured to a member of a structure (e.g., joist, beam, ceiling beam, ceiling joist, roof truss, wall stud, top, bottom, or side wall of a recess, floor joist, any other joist, beam, or stud etc.). The one or more mount may be configured to support one or more tube (e.g., a roller shade tube). The one or more tube may be rotatably attached to the mount and the one or more tube may include one or more shade. The one or more tube and/or mount may be configured to be in wired or wireless communication with a control mechanism to enable rotation of the tube. The one or more shade and the one or more tube may be configured such that a free end of the shade is moved away from and/or towards the one or more tube during rotation of the tube and/or shade.

Additionally, or alternatively, the system may include one or more attachment mechanism configured to be attached to a member of a structure (e.g., joist, beam, ceiling beam, ceiling joist, roof truss, wall stud, top, bottom, or side wall of a recess, floor joist, any other joist, beam, or stud etc.). The one or more attachment mechanism may include one or more fastener that is configured to enable another component, such as a spacer, to be removably attachment to the attachment mechanism.

The system may, also or alternatively, include the spacer that enables one or more gap to be created between a ceiling covering and the spacer. The one or more gap may be configured to enable the one or more shade to be deployed and/or retracted through the one or more gap. The spacer may include a corresponding fastener that is configured to enable the spacer to be removeably attached to the fastener of the attachment mechanism. The fastener and/or corresponding fastener may enable the spacer to move laterally and/or vertically within the opening. The spacer may also, or alternatively, include a spacer covering, which may include the same and/or visually similar material to the material of the ceiling covering. Additionally, or alternatively, the spacer may include a deflector that is configured to deflect the shade through one or more gap between the spacer and the ceiling covering. The spacer may include electrical, electronic, or other components (e.g., light source, camera, speaker, microphone, smoke detector, etc.). The one or more gap may prevent the formation of a visually unpleasing juncture. Additionally, or alternatively, the spacer may be oriented such that only the one or more gap used for the retraction and deployment of the one or more shade are created.

The system is described in the context of storing and/or deploying one or more shade from a ceiling. However, in other implementations, the system need not be so limited. For example, the system may be configured to store and/or deploy one or more shade in and/or from any portion of a structure (e.g., floor, wall, window frame, window ledge, counter, outdoor structures, etc.).

Additionally or alternatively, the system is described in the context of storing and/or deploying one or more roller shade. However, in other implementations, the system need not be so limited. For example, the system may also, or alternatively, be configured to store and deploy one or more screen, canvas, and/or other material for a variety of purposes (e.g., temporary flexible barriers, temporary screens, display art work, etc.). Additionally, or alternatively, the system may be configured to enable the storage and/or deployment of other types of shades (e.g., accordion, honeycomb shades, etc.).

Figure 1B:
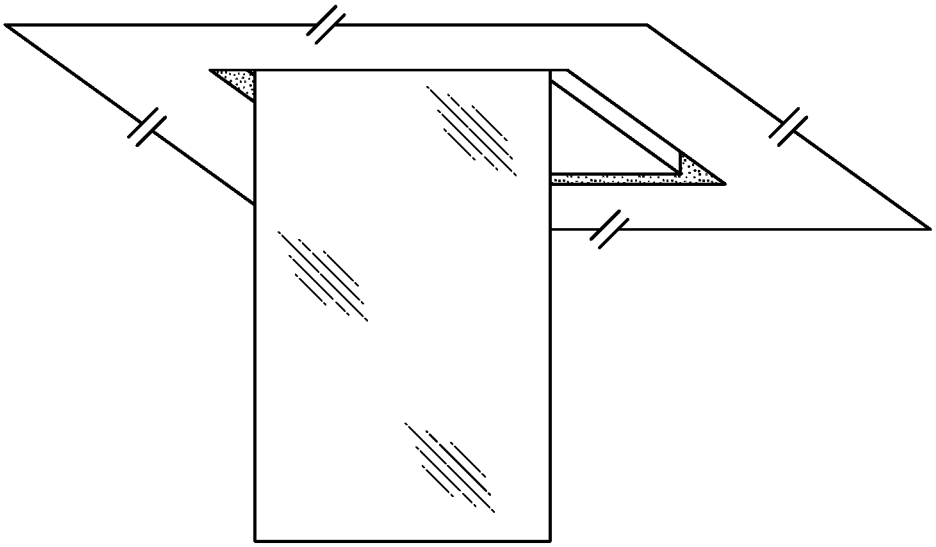
Figure 1C:
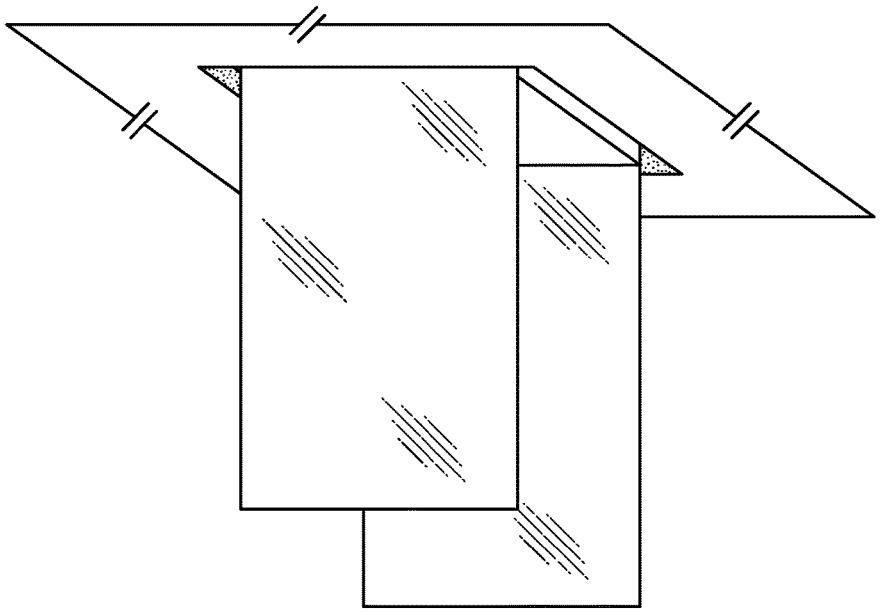

FIG. 1A-1C are perspective views of an example shade storage and deployment system according to an implementation described herein. As described in further detail below, the system may include a spacer that is configured to enable the creation of one or more gap between the spacer and a material covering the ceiling base. The one or more gap may allow one (e.g., FIG. 1B) or more (e.g., FIG. 1C) shade to be retracted and/or deployed for use.

Figure 1D:
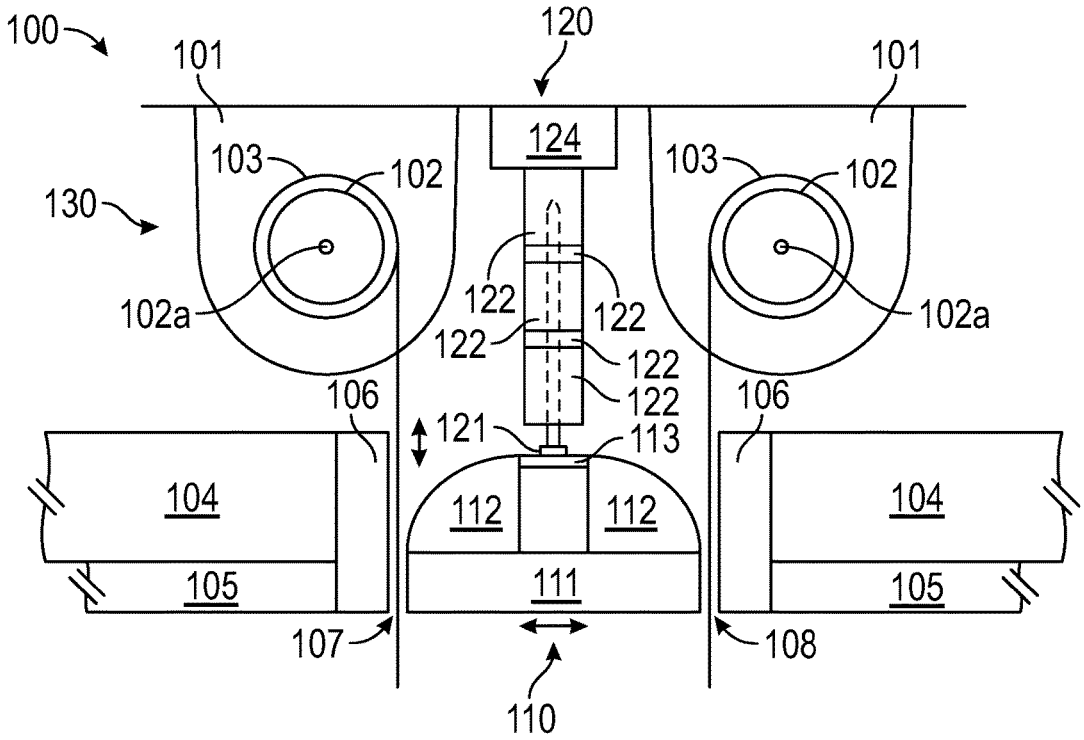
FIG. 1D is a diagram of the example shade storage and deployment system of FIGS. 1A-1C including more than one shade according to an implementation described herein.

FIG. 1D is a diagram of an example shade storage and deployment system 100 (hereinafter, "system 100") of FIGS. 1A-1C including more than one shade according to an implementation described herein. As shown in FIG. 1D, system 100 may include one or more mount 101 (hereinafter, "mount 100"), one or more rotatable tube 102 (hereinafter, "tube 102"), a spacer 110, and one or more attachment mechanism 120 (hereinafter, "attachment mechanism 120"). The number of components, illustrated in FIG. 1D (and/or FIGS. 1A-8), is provided for explanatory purposes only and is not intended to be so limited. There may be additional components, fewer components, different components, or differently arranged components than illustrated in FIG. 1D. Also, in some implementations, one or more of the components of system 100 may perform one or more functions described as being performed by another one or more of the components of system 100.

Mount 101 may be formed by a material of sufficient rigidity and strength to support the weight of tube 102, shade 103 and/or any static and/or dynamic loads (e.g., forces, torques, tensions, compressions, etc.) imparted on mount 101 by tube 102, shade 103, by one or more of components 102-124 and/or any additional components (e.g., control mechanism described below). Mount 101 may, for example, be made of metal, plastic, Teflon®, acrylic, urethane, wood, fiberglass, composite, etc., or some combination thereof. The strength and/or rigidity of the material may enable mount 101 to maintain a basic shape when being used and/or to enable various components to be attached to mount 101 and to be used.

Tube 102 may be formed by a material of sufficient rigidity and strength to support the weight of shade 103 and/or any static and/or dynamic loads (e.g., forces, torques, tensions, compressions, etc.) imparted on tube 102 by mount 101, shade 103, by one or more of components 102-124, and/or any additional components (e.g., control mechanism). Tube 102 may, for example, be made of metal, plastic, Teflon®, acrylic, urethane, wood, fiberglass, composite, etc. or some combination thereof. The strength and/or rigidity of the material may enable tube 102 to maintain a basic shape when being used, attached to mount 101 and/or any other component, and/or to enable various components to be attached to tube 102 and to be used.

The figures and description herein identify mount 101 as being disk-shaped and/or tube 102 as being generally circular in shape for explanatory purposes. Additionally, or alternatively, in other implementations, the shape need not be so limited. For example, mount 101 and/or tube 102 may be of any shape, such as circular, elliptical, triangular, square, pentagular, hexangular, octangular, etc.

Spacer 110 may include a spacer covering 111, one or more deflector 112 (hereinafter, "deflector 112"), and a corresponding fastener 113 (described in further detail below). Spacer covering 111 may be formed by a material of sufficient rigidity and strength to support the weight of deflector 112, corresponding fastener 113, and/or any other component of spacer 110, and/or any static and/or dynamic loads (e.g., forces, torques, tensions, compressions, etc.) imparted on spacer covering 111 by deflector 112, corresponding fastener 113, and/or by one or more of components 102-124 (and/or any additional components). Spacer covering 111 may, for example, be made of plaster, metal, plastic, Teflon, acrylic, urethane, wood, fiberglass, composite, etc. or some combination thereof. Spacer covering 111 may be made of a material that is the same as the material of horizontal covering 105 and/or vertical covering 106 (described in further detail below) (e.g., sheet rock, plaster, title, wood, metal, ceramic, etc.) or is made of a material that appears visually similar to the material of horizontal covering 105 and/or vertical covering 106 (e.g., medium density fiber ("MDF"), other fiberboard, etc.). The strength and/or rigidity of the material may enable spacer covering 111 to maintain a basic shape when being used, when being attached to and/or while attached to deflector 112 and/or any other component, and/or to enable various components to be attached to spacer covering 111 and to be used.

The figures and description herein identify spacer 110 and/or spacer covering 111 as being generally rectangular shape for explanatory purposes. Additionally, or alternatively, in other implementations, the shape need not be so limited. For example, spacer 110 and/or spacer covering 111 may be of any shape, such as circular, elliptical, triangular, square, pentagular, hexangular, octangular, etc. Additionally, or alternatively, spacer 110 and/or spacer covering 111 may include a flat shape, a convex shape, concave shape, or combination thereof such that spacer covering 111 may match the contour of horizontal covering 105 and/or vertical covering 106.

Deflector 112 may be formed by a material of sufficient rigidity and strength to support the weight of spacer covering 111, corresponding fastener 113, and/or any other components of spacer 110, and/or any static and/or dynamic loads (e.g., forces, torques, tensions, compressions, etc.) imparted on deflector 112 by spacer covering 111, corresponding fastener 113, and/or by one or more of components 102-124 (and/or any additional components). Deflector 112 may, for example, be made of metal, plastic, Teflon®, acrylic, urethane, wood, fiberglass, composite, plaster, sheet rock, etc., or some combination thereof. The strength and/or rigidity of the material may enable deflector 112 to maintain a basic shape when being used, when being attached to and/or while attached to spacer covering 111 and/or corresponding fastener 113, and/or any other component, and/or to enable various components to be attached to deflector 112 and to be used.

Additionally, or alternatively, deflector 112 may be configured to deflect a free end of shade 103 through gaps 107 and/or 108 (described in further detail below). For example, deflector 112 may include any shape that enables smooth or continuous deflection of shade 103 through gaps 107 and 108, e.g., such as a curved shape (as shown in FIGS. 1D-5 and 8), to enable the deflection of shade 103 while minimizing the risk of tearing and/or otherwise damaging shade 103. The shape of deflector 112 is not intended to be so limited.

The number of components of spacer 110, illustrated in the figures, is provided for explanatory purposes only and is not intended to be so limited. There may be additional components, fewer components, different components, or differently arranged components than illustrated in the figures. Also, in some implementations, one or more of the components of spacer 110 may perform one or more functions described as being performed by another one or more of the components of spacer 110. For example, the figures and description herein identify spacer 110 as including spacer covering 111 and deflector 112 as separate components, for explanatory purposes. Additionally, or alternatively, in other implementations, spacer 110 need not be so limited. In a non-limiting implementation, spacer covering 110 and deflector 112 may be formed as one component that includes one or more materials and/or one or more shape.

Attachment mechanism 120 may include one or more support 124 (hereinafter, "support 124"), one or more insert 122 (hereinafter, "insert 122"), and one or more fastener 121 (hereinafter, "fastener 121"). Support 124 may be formed by a material of sufficient rigidity and strength to support insert 122, fastener 121 (described in further detail below), spacer 110, and/or any other components of attachment mechanism 120 and/or spacer 110, and/or any static and/or dynamic loads (e.g., forces, torques, tensions, compressions, etc.) imparted on support 124 by insert 122, fastener 121, spacer 110, and/or by one or more of components 102-124 (and/or any additional components). Support 124 may, for example, be made of metal, plastic, Teflon®, acrylic, urethane, wood, fiberglass, composite, plaster, sheet rock, etc., or some combination thereof. The strength and/or rigidity of the material may enable support 124 to maintain a basic shape when being used, when being attached to and/or while attached to a structural support (e.g., beam, pillar, frame, wall, floor, etc.), insert 122, fastener 121, and/or any other component, and/or to enable various components to be attached to support 124 and to be used.

Insert 122 may be formed by a material of sufficient rigidity and strength to support fastener 121, corresponding fastener 113, spacer 110, and/or any other components of attachment mechanism 120 and/or spacer 110, and/or any static and/or dynamic loads (e.g., forces, torques, tensions, compressions, etc.) imparted on insert 122 by support 124, fastener 121, corresponding fastener 113, spacer 110, and/or by one or more of components 102-124 (and/or any additional components). Insert 122 may, for example, be made of metal, plastic, Teflon®, acrylic, urethane, wood, fiberglass, composite, plaster, sheet rock, foam, etc., or some combination thereof. The strength and/or rigidity of the material may enable insert 122 to maintain a basic shape when being used, when being attached to and/or while attached to support 124, fastener 121, and/or any other component, and/or to enable various components to be attached to insert 122 and to be used.

Figure 3:
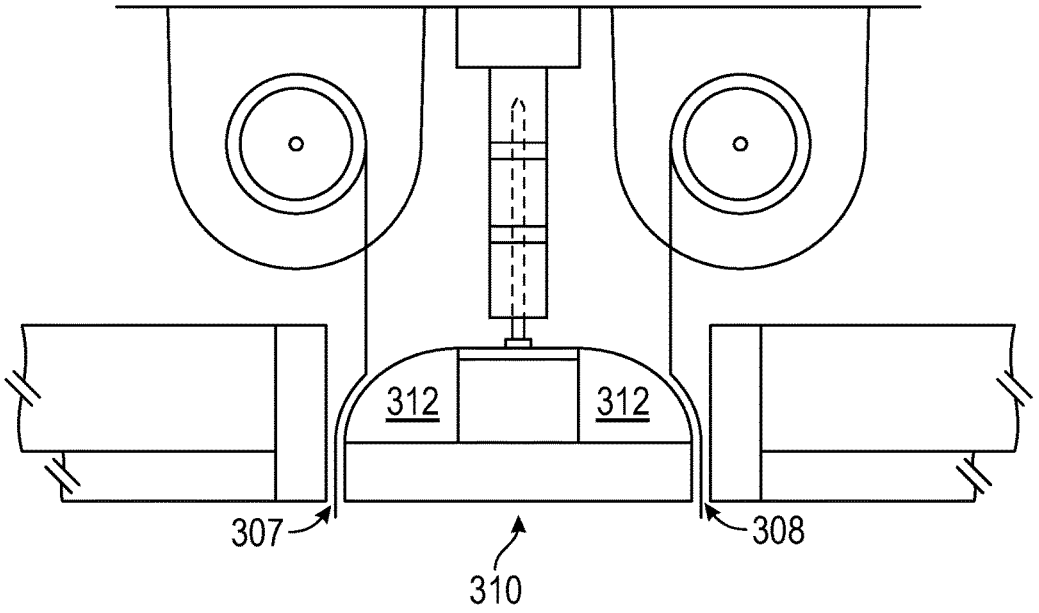
FIG. 3 is a diagram of an example shade storage and deployment system that includes a different spacer component than that shown in FIG. 1D and according to an implementation described herein.
Figure 4:
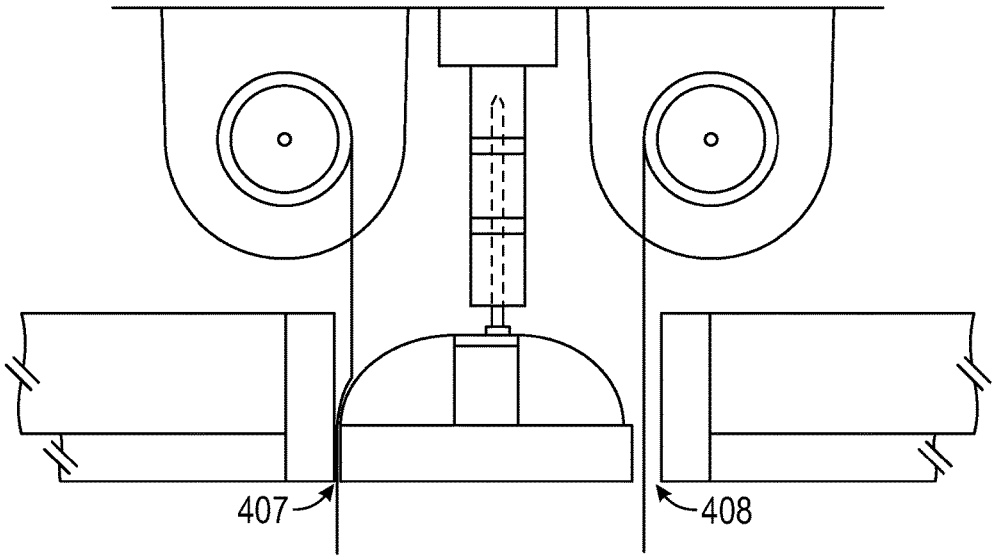
FIG. 4 is a diagram of an example shade storage and deployment system that includes a spacer component in a different position than that shown in FIG. 1D and according to an implementation described herein.
Figures 5A, 5B, 5C, 5D:
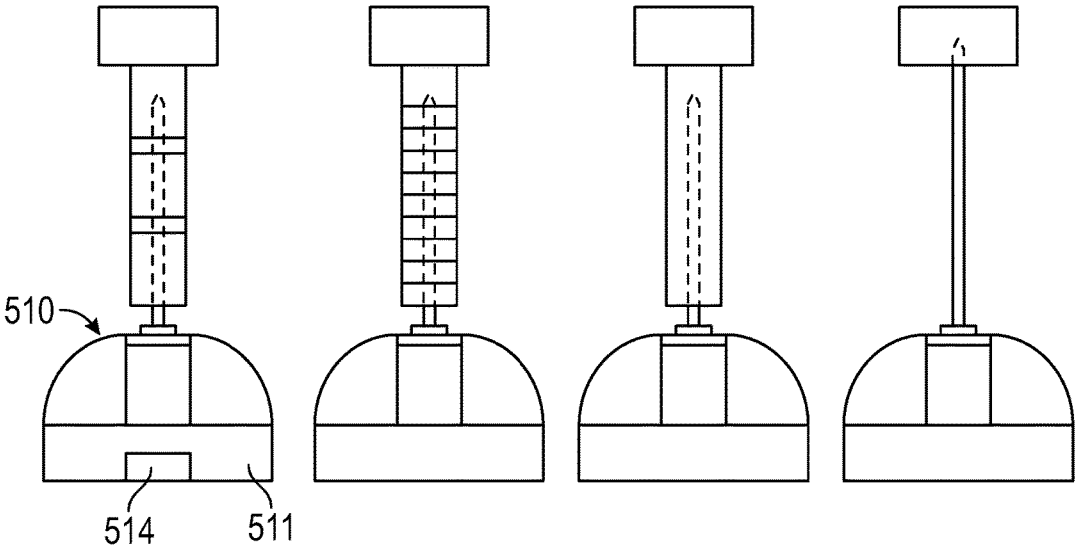
FIGS. 5A-5D are diagrams of example attachment mechanisms and spacer components of an example shade storage and deployment system according to an implementation described herein.

The figures and description herein identify support 124 and insert 122 as being generally rectangular shape for explanatory purposes. Additionally, or alternatively, in other implementations, the shape need not be so limited. For example, support 124 and/or insert 122 may be of any shape, such as circular, elliptical, triangular, square, pentagular, hexangular, octangular, etc. Additionally, or alternatively, while FIGS. 1D-5A illustrate the attachment mechanism as including five inserts (e.g., FIG. 5A), in other implementations, the attachment mechanism need not be so limited. For example, in a non-limiting implementation, the attachment mechanism may include more or less than five inserts (e.g., as shown in FIG. 5B-5C) or may not include any insert (e.g., as shown in FIG. 5D).

As shown in FIG. 1D, system 100 may be configured to be installed into recess 130, which may be formed, for example, within a ceiling, wall, floor, or other structural element. Mount 101 may be configured to be temporarily and/or permanently secured to a member of a structure (e.g., joist, beam, ceiling beam, ceiling joist, roof truss, wall stud, top, bottom, or side wall of a recess, floor joist, any other joist, beam, or stud etc.) and/or any other portion of a structure sufficient to support the weight and/or forces of mount 101, tube 102, and/or any additional component. For example, mount 101 may include one or more aperture that is configured to receive a screw and/or other appropriate fastening means. Mount 101 may be configured to support tube 102 and enable tube 102 to be rotatably attached to mount 101. For example, system 100 may include two mounts 101 per tube, i.e., one mount for each end of tube 102. Additionally, or alternatively, mount 101 may have one or more opening (not shown) that is configured to receive one end of (or a portion of one end of) tube 102, and/or tube 102 may interlock with the one or more opening. Additionally, or alternatively, the one or more opening may include a bearing that is configured to allow tube 102 to rotate freely about tube rotational axis 102*a*, minimizing friction and wear.

Figure 8:
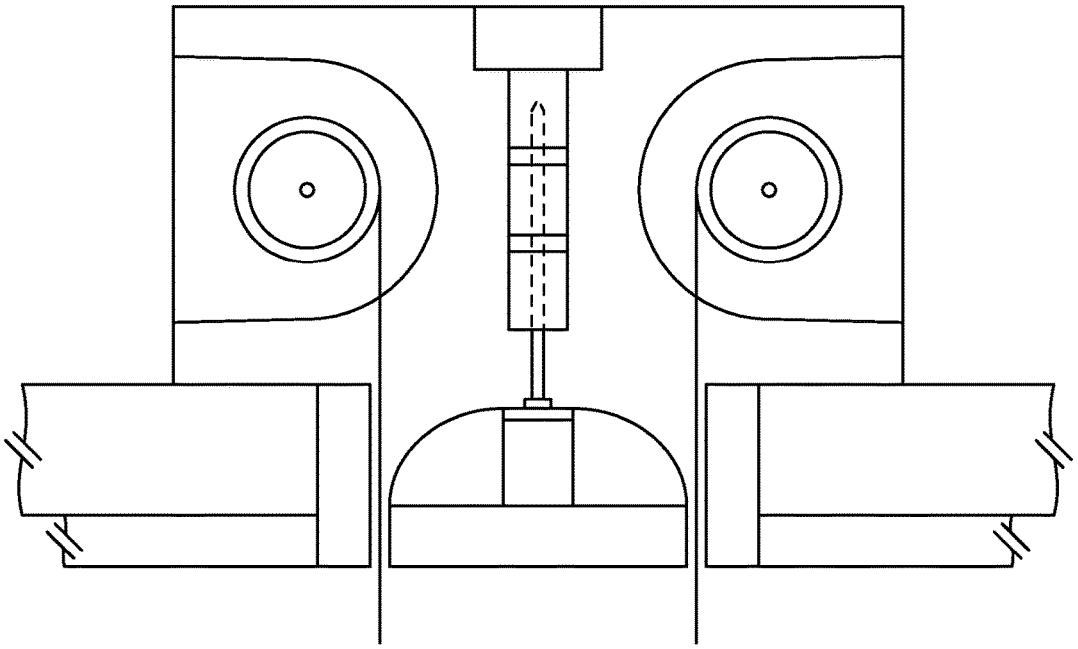
FIG. 8 is a diagram of an example shade storage and deployment system of FIGS. 1A-D that includes a mount component in a different position than that shown in FIG. 1D and according to an implementation described herein.
Figure 9A:
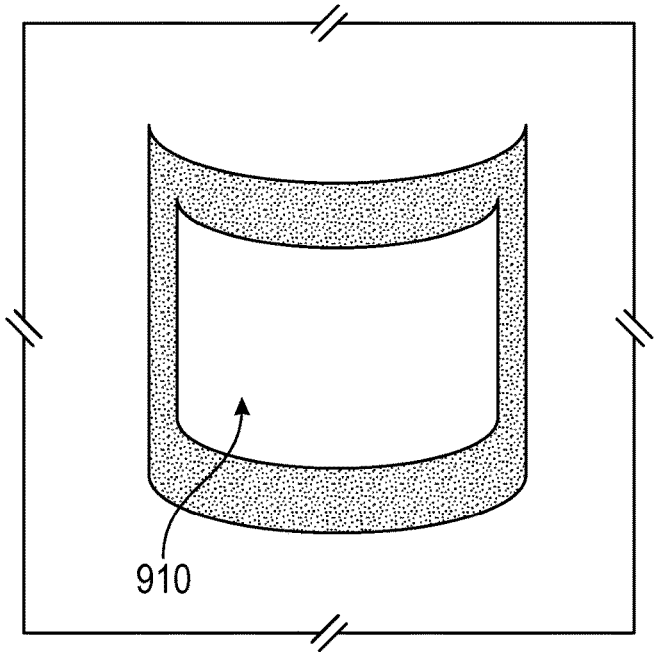
FIGS. 9A-C are bottom elevational views of an example shade storage and deployment system according to an implementation described herein.
Figure 9B:
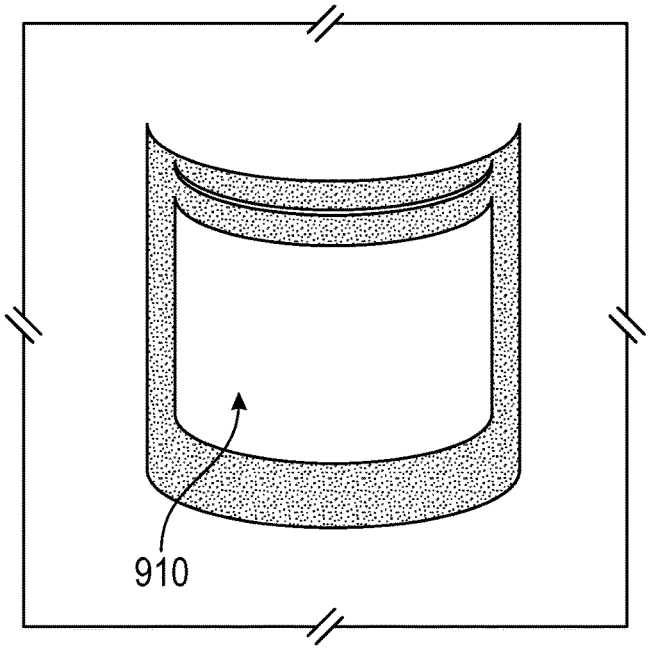
Figure 9C:
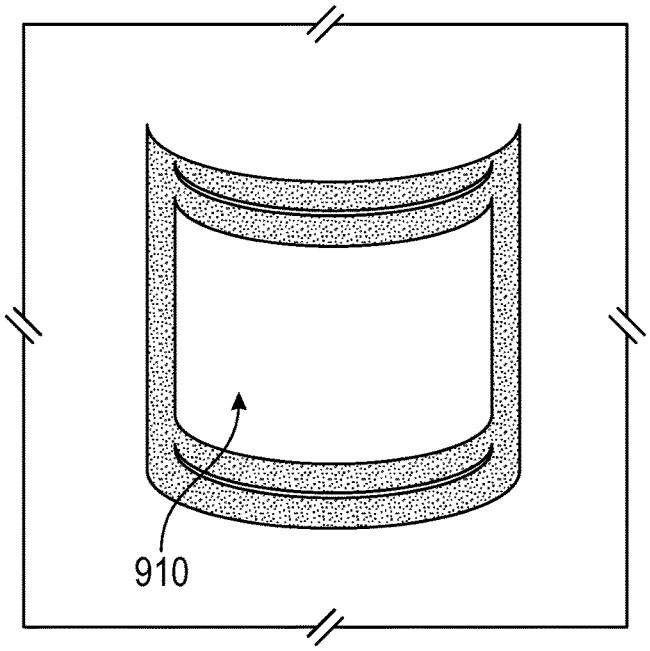
Figure 10A:
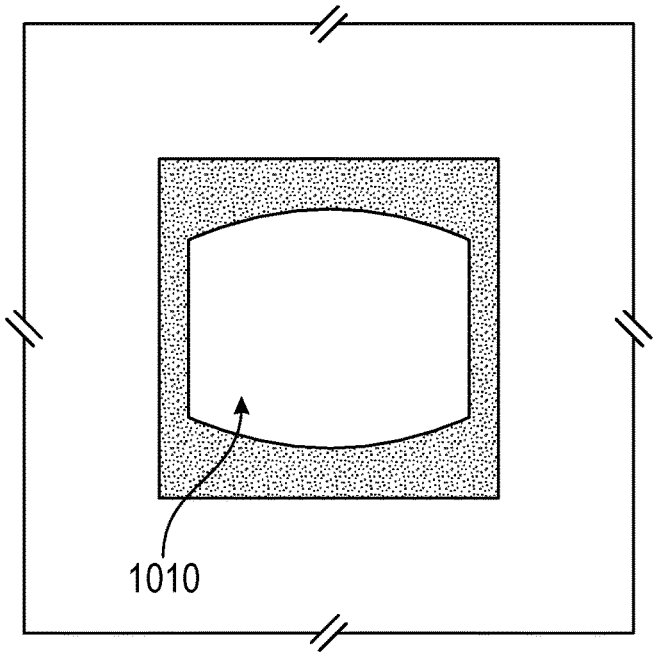
FIGS. 10A-C are diagrams of example shade storage and deployment systems that include different spacer components than that shown in FIGS. 6A-C and according to an implementation described herein.
Figure 10B:
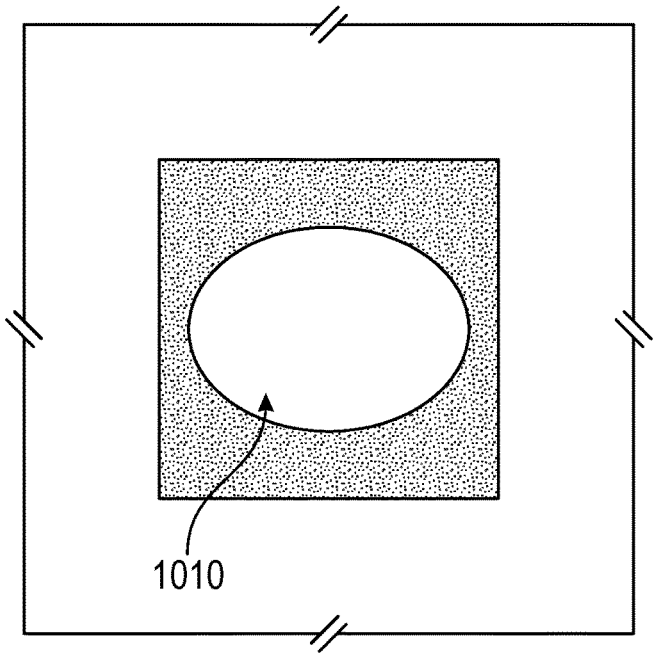
Figure 10C:
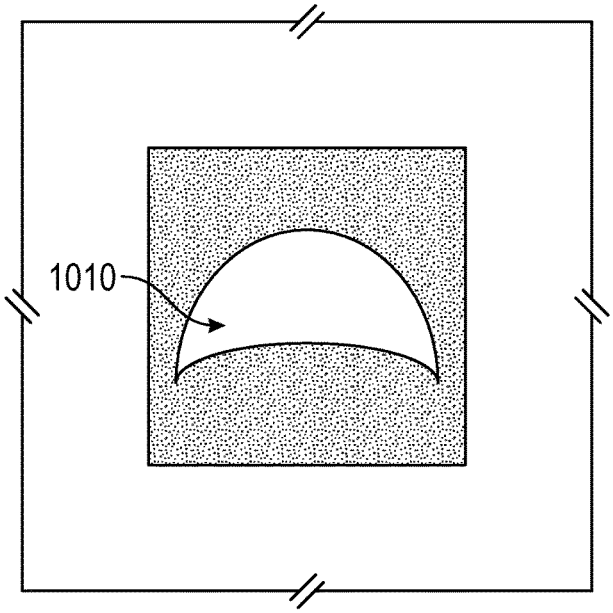
Figure 11:
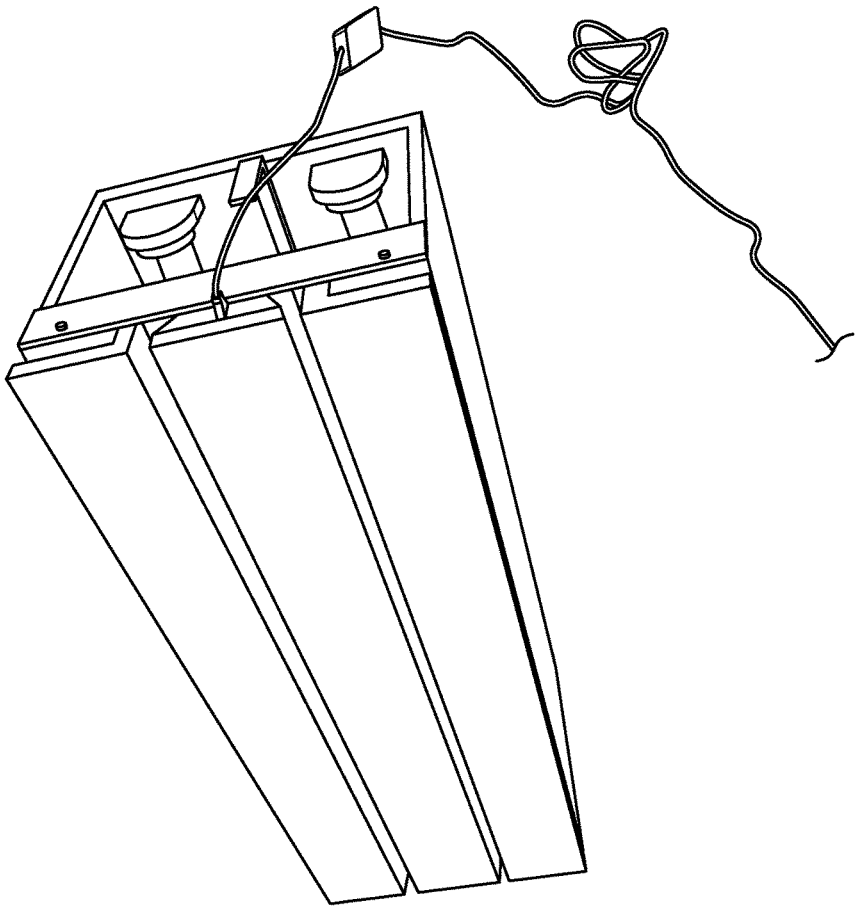
FIG. 11 is a bottom perspective view of an example assembly of a shade storage and deployment system.

In other implementations, mount 101 need not be so limited. Mount 101 may be configured to enable tube 102 to rotatably attach to mount 101 by any suitable means generally known in the art. Additionally, or alternatively, mount 101 may be configured such that one mount is sufficient to support tube 102 and allow tube 102 to rotatably attach to mount 101. Additionally, or alternatively, mount 101 may include a multiple mounting mechanism such that one mount may be configured to support two or more tubes and enable the two or more tubes to be rotatably attached to mount 101. Additionally or alternatively, the orientation of mount 101 shown in FIG. 1D is not intended to be limiting. FIG. 8 a diagram of an example shade storage and deployment system of FIGS. 1A-D that includes a mount component in a different position that shown in FIG. 1D and according to an implementation described herein. Mount 101 may be configured to be securely attached to a structural member in any orientation that enables mount 101 to support tube 102 and/or shade 103 (e.g., as shown in FIG. 8).

Tube 102 may be configured to be removably and rotatably attached to mount 101, such that tube 102 may rotate about tube rotational axis 102*a*. For example, tube 102 may include a mechanism (e.g., key, pin, groove, slot, tab, etc.) that may interlock with a bearing of mount 101. Additionally, or alternatively, tube 102 may itself include a pivotable mechanism configured to enable tube 102 to rotate about 102*a*. In other implementations, tube 102 need not be so limited. Tube 102 may be configured to enable tube 102 to rotate by any suitable means generally known in the art.

Mount 101 and/or tube 102 may be configured to connect to a control mechanism (e.g., motor, servo, air compressor, hydraulic, pneumatic, and/or some other mechanical control system) that is configured to provide a force (e.g., torque on a pin or bearing) to mount 101 and/or tube 102 to cause at least tube 102 to rotate. The control mechanism may be configured to be in wired and/or wireless communication with a user device (e.g., input device, keypad, PDA, phone, laptop, computer, remote control, etc.), sensor (e.g., motion, temperature, pressure, position, etc.), and/or other device (e.g., timer, measurement device, light switch, door, window, television, etc.). The user device, sensor, and/or other device may be configured to send a signal to the control mechanism to automatically rotate (e.g., counter-clockwise, clockwise) tube 102 about tube rotational axis 102*a* and/or at least a portion of mount 101.

Figure 2:
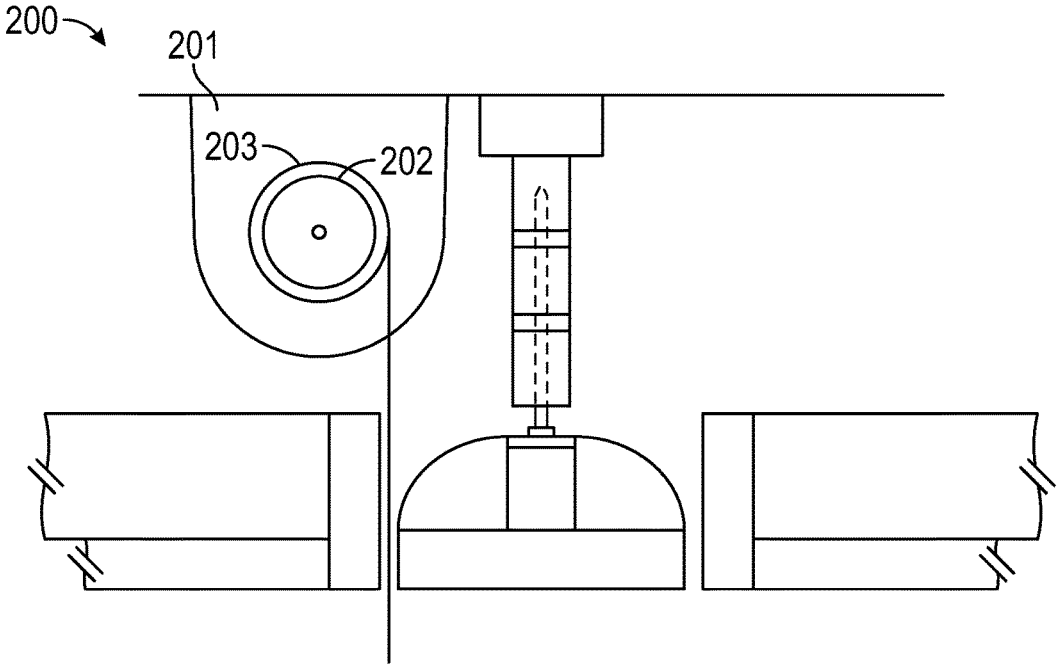
FIG. 2 is a diagram of an example shade storage and deployment system including one shade according to an implementation described herein.

One or more shade 103 (hereinafter, "shade 103") may be disposed on and/or wound around tube 102 by any known technique in the art, such that rotation of tube 102 may enable a free end of shade 103 to move away from and/or towards tube 102, and/or to be deployed and/or retracted through gaps 107 and/or 108. Shade 103 may be made of any material known in the art of suitable properties (e.g., strength, density, transparency, opaqueness, etc.) and may also, or alternatively, be made of a pliable and/or flexible material that is suitable to be controlled (e.g., bent, conformed, curved, deformed, etc.) upon contact with spacer 110, such that shade 103 may conform to a same or similar shape of spacer 110 when brought into contact with spacer 110 ("shaped controlled") (as further described below). FIG. 1D and the description herein identify system 100 as including two tubes 102 and two shades 103. Additionally, or alternatively, in other implementations, the number of tubes and shades need not be so limited. For example, FIG. 2 is a diagram of an example shade storage and deployment system 200, which may include only one tube 202 and/or shade 203.

Returning to FIG. 1D, attachment mechanism 120 may be configured to be temporarily and/or permanently secured to a member of a structure (e.g., joist, beam, ceiling beam, ceiling joist, roof truss, wall stud, top, bottom, or side wall of a recess, floor joist, any other joist, beam, or stud etc.) and/or any other portion of a structure sufficient to support the weight of attachment mechanism 120, spacer 110, and/or any additional component. Attachment mechanism 120 may include support 124, which may be temporarily or permanently secured (e.g., via screw, nail, glued, Velcro®, epoxy, etc.) to a member of a structure. Attachment mechanism 120 may, also or alternatively, include fastener 121, which may be directly attached to support 124 (e.g., via threaded engagement, etc.) (as shown in FIG. 5D). Additionally, or alternatively, fastener 121 may be attached to insert 122 (e.g., wooden insert, polymer insert, metal insert, nuts, bolts, etc.) and insert 122 may be attached to support 124 (e.g., via screw, nail, glued, Velcro, epoxy, etc.). Insert 122 may be configured to provide additional support and/or rigidity to fastener 121. Additionally or alternatively, fastener 121 may be configured to be adjustable in length by any normal methods known in the art (e.g., via adjustment of threaded engagement, telescopic adjustment mechanism, etc.). The number of inserts 122 attached to fastener 121 may depend on, for example, the length of fastener 121.

Spacer 110 may include corresponding fastener 113, which may be configured to enable spacer 110 to be removably attached to fastener 121. Fastener 121 and corresponding fastener 113 may include, for example, attracting magnets with magnetic force that is strong enough to overcome gravitational force and securely attach spacer 110 to fastener 122 without spacer 110 falling, yet weak enough to enable removal of spacer 110. In other implementations, the type of fastener 121 and corresponding fastener 113 need not be so limited. For example, fastener 121 and corresponding fastener 113 may include any fastening mechanism sufficient to secure spacer 110 to fastener 121 (e.g., key and slot, button, male-female connection, groove and tongue, tab and slot, Velcro®, etc.).

The shapes and sizes of fastener 121 and corresponding fastener 113 shown in the figures and described herein are not intended to be limiting. Additionally or alternatively, in other implementations, fastener 121 and corresponding fastener 113 may be of any shape, dimensions, and/or size suitable to enable removable attachment of spacer 110 and attachment mechanism 120. For example, the width of corresponding fastener 113 and/or fastener 121 may be as wide as (or nearly as wide as) spacer 110 or a portion of spacer 110 to enable further lateral movement of spacer 110 within a partial opening of recess 130.

As shown in FIG. 1D, an opening of recess 130 may be partially covered by ceiling base 104 (e.g., joist, beam, truss, etc.), leaving a partial opening of recess 130. Additionally, or alternatively, ceiling base 104 may include horizontal covering 105 and vertical covering 106 (e.g., made of plaster, wood, sheet rock, ceramic, metal, or a combination thereof, etc.) to effectively prohibit ceiling base 104 from being visual in plain view. The number, shape, size, and/or orientation of ceiling coverings 105 and/or 106 shown in the figures and described herein are not intended to be limited. Additionally, or alternatively, ceiling coverings may include any number, shape, size, and/or orientation necessary to effectively prohibit the ceiling base from being visual in plain view.

Spacer 110 may be oriented into the partial opening of recess 130 such that two gaps 107 and 108 exist between spacer 110 and vertical covering 106 (and/or horizontal cover 106). Gaps 107 and 108 may prevent the abutment of spacer 110 with vertical covering 106 and/or horizontal covering 105, and effectively eliminate a visually unpleasing juncture. This may increase the aesthetic value of the structure, and/or the monetary value of the structure. Additionally, or alternatively, spacer 110 may be oriented to allow one or more shade 103 to be deployed and/or retracted through gaps 107 and 108, without deflection from deflector 112, as shown for example in FIG. 1D.

Additionally, or alternatively, the spacer may be adjusted in size to decrease and/or increase the size of the gaps through which a shade is deployed and/or retracted. FIG. 3 is a diagram of an example shade storage and deployment system that includes a different spacer component than that shown in FIG. 1D and according to an implementation described herein. For example, as shown in FIG. 3, spacer 310 may be oriented in the partial opening of recess 130 (e.g., via removal of spacer 110 and replacement with 310). Spacer 310 may be wider than spacer 110 enabling the gaps 307 and 308 to be smaller than gaps 107 and/or 108. Additionally, or alternatively, if spacer 310 impedes the direct path of shade 103 to gaps 307 and/or 308, deflector 312 may deflect shade 103 through gaps 307 and/or 308. Shade 103 may be made of any material known in the art of suitable properties (e.g., strength, density, transparency, opaqueness, etc.) and may also, or alternatively, be made of a pliable and/or flexible material that is suitable to be controlled (e.g., bent, conformed, curved, deformed, etc.) upon contact with spacer 310. For example, shade 103 may conform to a same or similar shape of spacer 310 when brought into contact with spacer 310 ("shaped controlled"). The controlling of a shape (e.g., bending, conforming, curving, deforming, etc.) of a shade via contact with a spacer is further described below with reference to FIGS. 9A-C and FIGS. 10A-C.

Additionally, or alternatively, the position of spacer 110 may be adjusted horizontally. FIG. 4 is a diagram of an example shade storage and deployment system that includes a spacer component in a different position that than shown in FIG. 1D and according to an implementation described herein. As shown in FIG. 4, fastener 121 and corresponding fastener 113 may enable horizontal movement of spacer 110, such that gaps 407 and 408 may be of different sizes relative to one another. Additionally, or alternatively, shade 103 may be deflected by deflector 112 through gap 407 if spacer 110 impedes the direct path of the free end of shade 103 through gap 407.

Additionally or alternatively, the position of spacer 110 may be adjusted vertically. For example, in one non-limiting implementation, adjustment of the length of fastener 122 may enable vertical adjustment of spacer 110, such that the outermost surface of spacer covering 111 may align with the outermost surface of horizontal covering 105. In another implementation, spacer 110 may be configured to be adjusted vertically by other mechanisms, e.g., via adjustment of corresponding fastener 113.

Additionally, or alternatively, the spacer may be configured to include electrical, electronic, and/or other elements. FIG. 5A is a diagram of an example attachment mechanism and spacer component of an example shade storage and deployment system according to an implementation described herein. For example, as shown in FIG. 5A, spacer 510 may include lighting element 514 (e.g., LED, halogen, fluorescent, neon, etc.). Lighting element 514 may be configured to be adjustable (e.g., via ball and socket connection, etc.) such that light emitted from lighting element 514 may be directed in a desired direction. Additionally or alternatively, lighting element 514 may be installed on the surface of and/or within spacer cover 511. Additionally, or alternatively, other elements (e.g., camera, alarm, speaker, microphone, smoke detector, security device, sensor, etc.) may be installed on and/or within spacer 510.

Figure 6A:
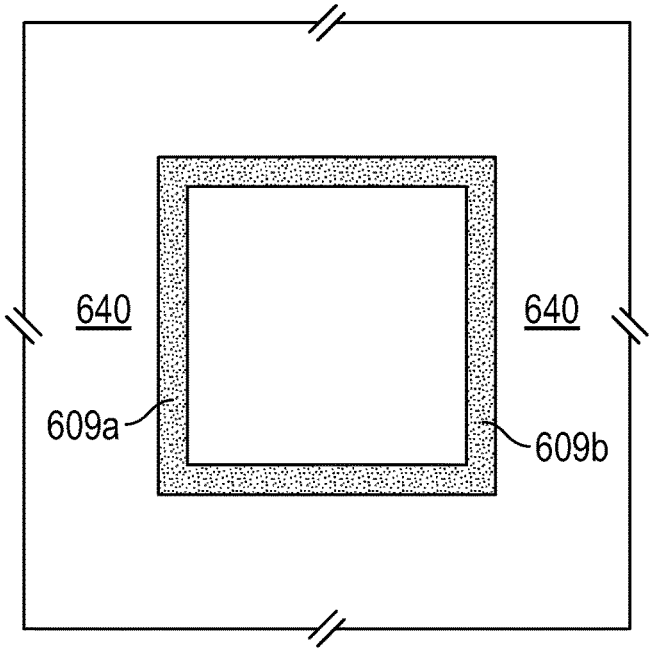
FIGS. 6A-6C are bottom elevational views of the example shade storage and deployment system of FIGS. 1A-1C.
Figure 6B:
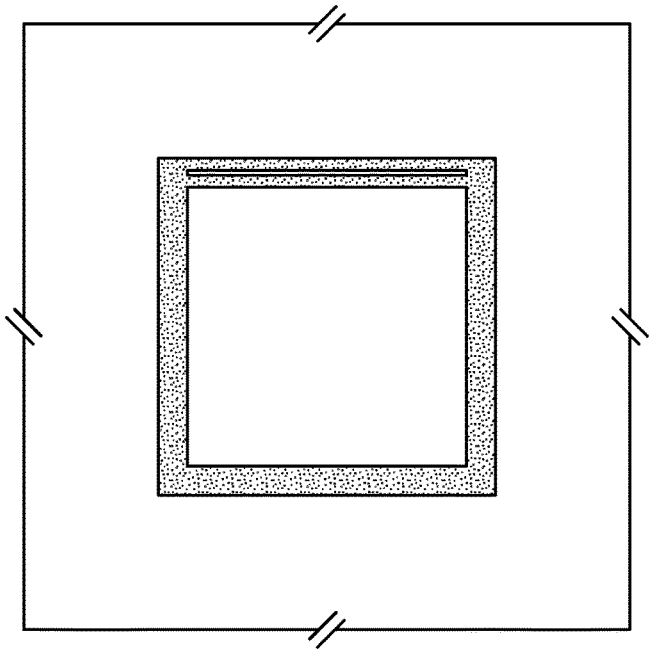
Figure 6C:
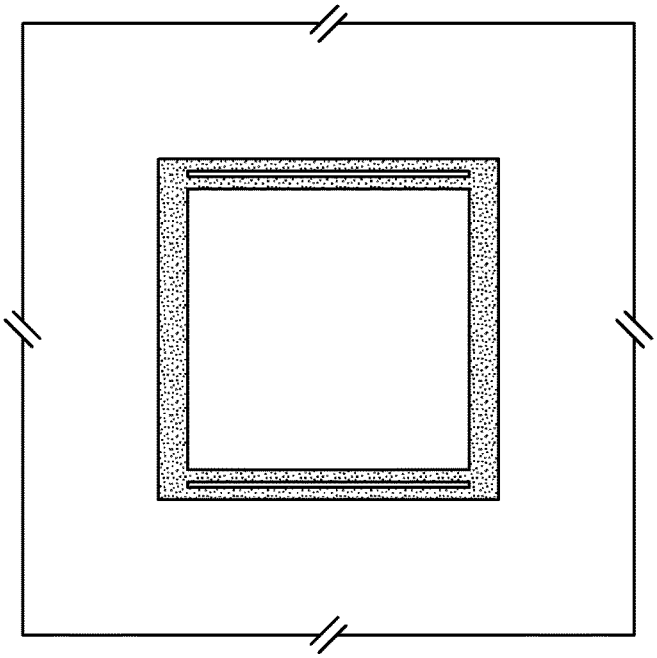
Figure 7:
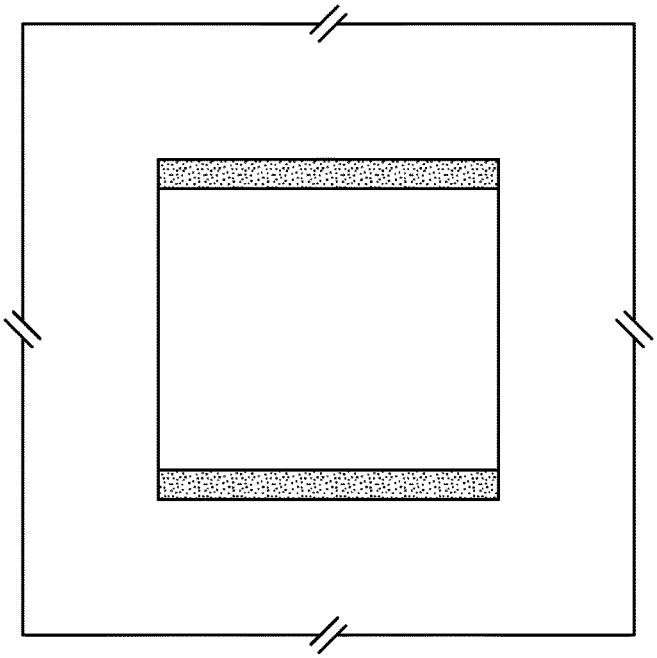
FIG. 7 is a bottom elevational view of an example shade storage and deployment system according to an implementation described herein.

FIGS. 6A-6C are bottom elevational views of the example shade storage and deployment system of FIGS. 1A-1C. Additionally, or alternatively, as shown in FIGS. 6A-6C, the spacer may be configured to create gaps 609*a* and/or 609*b*. For example, spacer 110 may be oriented to create gaps 609*a* and/or 609*b* between spacer 110 and ceiling covering 640. Gaps 609*a* and/or 609*b* may be adjustable in size in accordance with the techniques described herein. Gaps 609*a* and/or 609*b* may prevent the abutment of spacer 110 with ceiling covering 640. The size of gaps 107, 108, 609*a*, and/or 609*b* are not intended to be limiting.

The figures and description herein generally show spacer 110, gaps 107, 108, 609*a*, 609*b*, horizontal covering 105, and/or vertical covering 106 as generally being rectangular shape for explanatory purposes. In other implementations, the shape of spacer 110, gaps 107, 108, 609*a*, 609*b*, horizontal covering 105 and/or vertical covering 106 need not be so limited. Spacer 110, gaps 107, 108, 609*a*, 609*b*, horizontal covering 105 and/or vertical covering 106 may be of any shape. For example, gaps 107, 108, 609*a*, and/or 609*b* may include curved, concave, convex, zip-zag, circular, elliptical, triangular, square, pentagular, hexangular, octangular shapes, etc. The shape of gaps 107, 108, 609*a*, and/or 609*b* may be formed by the shapes of spacer 110, spacer covering 111, horizontal covering 105, and/or vertical covering 106, which may be of any shape (e.g., curved, concave, convex, zip-zag, circular, elliptical, triangular, square, pentagular, hexangular, octangular, etc.).

For example, as shown in FIGS. 9A-C and FIGS. 10A-C, spacer 910, 1010 may include convex and/or concave shapes. A curved shape of spacer 910, 1010 (and/or a curved shape of a horizontal covering, vertical covering, gap, partial opening of recess, etc.) may enable spacer 1010 to make contact with a shade and, based on the application, may control the shape (e.g., curvature, contour, deformation, etc.) of the shade as deployed through a gap. Such a curved shade may improve the aesthetic features of a room (e.g., by preventing a visually unpleasing juncture from forming between the horizontal and/or vertical coverings and the spacer, etc.)

In other implementations, the shape of the spacer, horizontal covering, vertical covering, gap, and/or partial opening of the recess shown in FIGS. 9A-C and FIGS. 10A-C need not be so limited. For example, the spacer, horizontal covering, vertical covering, gap, and/or partial opening of the recess may include a shape and/or be oriented to maintain parallel edges between the spacer and the horizontal and/or vertical coverings (e.g., FIGS. 6A, 9A). Said another way, the width of a gap may be generally constant, whether straight (e.g., FIG. 6A) or curved (e.g., FIG. 9A). Additionally or alternatively, the spacer, horizontal covering, vertical covering, gap, and/or partial opening of the recess may include a shape and/or be oriented such that the edges between the spacer and the horizontal and/or vertical coverings are not parallel. Said another way, the width of a gap may not be constant (e.g., FIGS. 10A-C). Additionally, or alternatively, the dimensions of the spacer may be increased to eliminate gaps 609*a* and/or 609*b*, as shown for example, in FIG. 7, which is a bottom elevational view of an example shade storage and deployment system according to an implementation described herein.

The described system may, for example, be installed according to the following method. One or more mount may be securely attached to at least a portion of a member of a structure. One or more tube may be removably and rotatably attached to the one or more mount. The one or more mount and/or one or more tube may be connected to a control mechanism configured to cause, at least, the tube to rotate. One or more shade may be securely attached to the one or more tube, such that a free end of the one or more tube may move away from and/or towards the tube when the tube is rotated. An attachment mechanism may be secured to at least a portion of a member of a structure. A spacer may be removably attached to the attachment mechanism via a fastener, to create one or more gap between the spacer and a ceiling base and/or a covering thereto. The spacer may be oriented to enable a free end of the one or more shade to move into and out of the one or more gap. The number and/or order of steps of the foregoing method are not intended to be limiting. Additionally, or alternatively, the method may include additional, fewer, and/or different steps and/or the steps may be performed in a different order than described herein. Additionally, or alternatively, one or more steps of the method may be repeated.

What is claimed is:

1. A window shade storage and deployment system, comprising:

a recess formed in a ceiling and configured to house a first window shade and a second window shade, wherein the first and second window shades are movable between a retracted position and an extended position; and an access panel removably attached to a surface of the recess such that a visible surface of the access panel occupies the same plane as a visible surface of the ceiling surrounding the recess, wherein a first gap is provided between a first side of the access panel and a first edge of the ceiling, wherein a second gap is provided between a second side of the access panel and a second edge of the ceiling, wherein the first gap is configured to enable the first window shade to extend through the first gap from the recess to an area below the visible surface of the ceiling when the first window shade is in the extended position, and wherein the second gap is configured to enable the second window shade to extend through the second gap from the recess to the area below the visible surface of the ceiling when the second window shade is in the extended position;

wherein the visible surface of the access panel and the visible surface of the ceiling include the same or a similar material such that the visible surface of the access panel and the visible surface of the ceiling are visibly substantially identical.

2. The window shade storage and deployment system of claim 1, wherein the access panel includes a cover comprising the same or similar material as the visible surface of the ceiling such that a visible surface of the cover and the visible surface of the ceiling are visibly substantially identical.

3. The window shade storage and deployment system of claim 2, wherein a shape of the cover matches a contour of the visible surface of the ceiling.

4. The window shade storage and deployment system of claim 1, wherein the visible surface of the access panel comprises a first material and the visible surface of the ceiling comprises a second material, and wherein the first material is configured to be visibly substantially identical to the second material, and wherein the first material is a different material than the second material.

5. The window shade storage and deployment system of claim 4, wherein a visible characteristic of the first material is the same as or substantially similar to a visible characteristic of the second material, and wherein the visible characteristic includes at least one of a reflectivity and opacity.

6. The window shade storage and deployment system of claim 1, wherein the access panel includes a deflector configured to interface with the first window shade to deflect a free end of the first window shade when the first window shade moves to the extended position through the first gap from the recess to the area below the visible surface of the ceiling.

7. The window shade storage and deployment system of claim 1, wherein the first side of the access panel is opposite the second side of the access panel.

8. The window shade storage and deployment system of claim 1, wherein the first window shade is configured to be more transparent than the second window shade.

9. The window shade storage and deployment system of claim 1, further comprising a window shade roller housed in the recess and coupled to the first window shade, wherein the window shade roller is configured to rotate in a first direction causing the first window shade to retract, and wherein the window shade roller is configured to rotate in a second direction causing the first window shade to extend through the first gap from the recess to the area below the visible surface of the ceiling.

10. The window shade storage and deployment system of claim 9, further comprising an electrical component coupled to the access panel.

11. The window shade storage and deployment system of claim 10, wherein the electrical component is configured to power the window shade roller.

12. The window shade storage and deployment system of claim 10, wherein the electrical component includes at least one of a light source, a camera, a microphone, and a smoke detector.

13. A shade storage and deployment system, comprising:

a recess formed in a ceiling and configured to house a first shade and a second shade, wherein the first and second shades are movable between a retracted position and an extended position; and an access panel removably attached to a surface of the recess such that a visible surface of the access panel occupies the same plane as a visible surface of the ceiling surrounding the recess, wherein a first gap is provided between a first edge of the access panel and a first edge of the ceiling and a second gap is provided between a second edge of the access panel and a second edge of the ceiling, and wherein the first gap is configured to enable the first shade to extend through the first gap from the recess to an area below the visible surface of the ceiling when the first shade is in the extended position, and wherein the second gap is configured to enable the second shade to extend through the second gap from the recess to the area below the visible surface of the ceiling when the second shade is in the extended position;

wherein the visible surface of the access panel and the visible surface of the ceiling include the same or a similar material such that the visible surface of the access panel and the visible surface of the ceiling are visibly substantially identical.

14. The shade storage and deployment system of claim 13, wherein a third gap is provided between a third edge of the access panel and a third edge of the ceiling, and wherein a fourth gap is provided between a fourth edge of the access panel and a fourth edge of the ceiling.

15. The shade storage and deployment system of claim 13, wherein a length of the access panel and a length of the first shade are substantially the same.

16. A window shade storage and deployment assembly, comprising:

a housing configured to be installed in a recess of a ceiling, the housing comprising:

a visible surface of the housing configured to occupy substantially the same plane as a visible surface of the ceiling surrounding the housing when the housing is installed in the recess of the ceiling;

a first window shade movable between a retracted position and an extended position, wherein the housing is configured to house a second window shade movable between a retracted position and an extended position; and an access panel removably attached to a surface of the housing such that a visible surface of the access panel occupies substantially the same plane as the visible surface of the housing, wherein a first gap is provided between an edge of the access panel and the visible surface of the housing, wherein the first gap is configured to enable the window shade to extend through the first gap from the housing to an area below the visible surface of the ceiling when the first window shade is in the extended position, and wherein a second gap is configured to enable the second window shade to extend through the second gap from the housing to the area below the visible surface of the ceiling when the second shade is in the extended position;

wherein the visible surface of the access panel and the visible surface of the housing include the same or a similar material as the visible surface of the ceiling such that the visible surface of the access panel, the visible surface of the housing, and the visible surface of the ceiling are visibly substantially identical.

17. The window shade storage and deployment assembly of claim 16, further comprising an electrical component coupled to the access panel and configured to power a shade roller located in the housing.

18. The window shade storage and deployment system of claim 1, further comprising:

a window shade roller coupled to the first window shade and disposed within the recess; and an attachment mechanism extending from the access panel to an upper surface of the recess disposed above the window shade roller, wherein the access panel is disposed below the window shade roller, and wherein the attachment mechanism selectively couples the access panel to the upper surface of the recess.

19. The shade storage and deployment system of claim 13, further comprising:

a shade roller coupled to the first shade and disposed within the recess; and an attachment mechanism extending from the access panel to an upper surface of the recess disposed above the shade roller, wherein the access panel is disposed below the shade roller, and wherein the attachment mechanism selectively couples the access panel to the upper surface of the recess.

20. The window shade storage and deployment system of claim 16, further comprising:

a window shade roller coupled to the first window shade and disposed within the housing; and an attachment mechanism extending from the access panel to an upper surface of the housing disposed above the window shade roller, wherein the access panel is disposed below the window shade roller, and wherein the attachment mechanism selectively couples the access panel to the upper surface of the housing.

* * * * *